US011424529B2

(12) United States Patent
Ryu et al.

(10) Patent No.: US 11,424,529 B2
(45) Date of Patent: Aug. 23, 2022

(54) ANTENNA STRUCTURE AND DISPLAY DEVICE INCLUDING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Han Sub Ryu, Gyeongsangbuk-do (KR); Yun Seok Oh, Gyeonggi-do (KR); Young Jun Lee, Seoul (KR); Won Bin Hong, Seoul (KR)

(73) Assignees: DONGWOO FINE-CHEM CO., LTD., Jeollabuk-Do (KR); POSTECH RESEARCH AND BUSINESS DEVELOPMENT FOUNDATION, Gyeongsangbuk-Do (KR)

( * ) Notice: Subject to any disclaimer, the term of this patent is extended or adjusted under 35 U.S.C. 154(b) by 220 days.

(21) Appl. No.: 16/852,912

(22) Filed: Apr. 20, 2020

(65) Prior Publication Data

US 2020/0243959 A1 Jul. 30, 2020

Related U.S. Application Data

(63) Continuation of application No. PCT/KR2020/000592, filed on Jan. 13, 2020.

(30) Foreign Application Priority Data

Jan. 22, 2019 (KR) ..... 10-2019-0008181

(51) Int. Cl.

| | |
|---|---|
| ***H01Q 1/38*** | (2006.01) |
| ***H01Q 9/04*** | (2006.01) |
| ***H01Q 1/22*** | (2006.01) |

(52) U.S. Cl.

CPC ..... *H01Q 1/38* (2013.01); *H01Q 1/22* (2013.01); *H01Q 9/0407* (2013.01)

(58) Field of Classification Search

CPC ..... H01Q 1/38; H01Q 9/0407; H01Q 1/22; H01Q 1/243; H01Q 1/24; H01Q 1/44

See application file for complete search history.

(56) References Cited

U.S. PATENT DOCUMENTS

| | | | | |
|---|---|---|---|---|
| 2006/0066487 | A1* | 3/2006 | Park | H01Q 1/38 343/700 MS |
| 2016/0190678 | A1* | 6/2016 | Hong | H01Q 1/38 343/700 MS |
| 2021/0141426 | A1* | 5/2021 | Kim | H01Q 1/38 |

FOREIGN PATENT DOCUMENTS

| | | | |
|---|---|---|---|
| CN | 201229986 | Y | 4/2009 |
| CN | 101904050 | A | 12/2010 |

(Continued)

OTHER PUBLICATIONS

PCT Written Opinion of the International Searching Authority (Year: 2020).*

*Primary Examiner* — David E Lotter

(74) *Attorney, Agent, or Firm* — The PL Law Group, PLLC

(57) ABSTRACT

An antenna structure includes a dielectric layer, a radiation pattern on the dielectric layer and a signal pad on the dielectric layer. The signal pad includes a bonding region that is electrically connected to the radiation pattern and is configured to be bonded to an external circuit structure, and a margin region adjacent to the bonding region. Impedance mismatching is prevented by the margin region so that radiation efficiency is improved.

16 Claims, 8 Drawing Sheets

(56) References Cited

FOREIGN PATENT DOCUMENTS

| | | | | |
|---|---|---|---|---|
| CN | 107872919 | A | | 4/2018 |
| JP | 2002-314325 | A | | 10/2002 |
| JP | 2017-175540 | A | | 9/2017 |
| KR | 10-2006-0088073 | A | | 8/2006 |
| KR | 10-20080050267 | | * | 6/2008 |
| KR | 10-2009-0133072 | A | | 12/2009 |
| KR | 10-2013-0095451 | A | | 8/2013 |
| KR | 10-1457004 | B1 | | 11/2014 |
| KR | 10-2016-0080444 | A | | 7/2016 |
| KR | 10-1744886 | | * | 6/2017 |

* cited by examiner

ANTENNA STRUCTURE AND DISPLAY DEVICE INCLUDING THE SAME

CROSS REFERENCE TO RELATED APPLICATIONS AND CLAIM OF PRIORITY

The present application is a continuation application to International Application No. PCT/KR2020/000592 with an International Filing Date of Jan. 13, 2020, which claims the benefit of Korean Patent Application No. 10-2019-0008181 filed on Jan. 22, 2019 at the Korean Intellectual Property Office, the disclosures of which are incorporated by reference herein in their entirety.

BACKGROUND

1. Field

The present invention relates to an antenna structure and a display device including the same. More particularly, the present invention related to an antenna structure including an electrode and a dielectric layer and a display device including the same.

2. Description of the Related Art

As information technologies have been developed, a wireless communication technology such as Wi-Fi, Bluetooth, etc., is combined with a display device in, e.g., a smartphone. In this case, an antenna may be combined with the display device to provide a communication function.

Mobile communication technologies have been rapidly developed, and an antenna capable of operating an ultra-high frequency communication is needed in the display device.

Further, as a display device including the antenna becomes more thinner and light-weighted, a space for the antenna may be also reduced. Accordingly, a high frequency and broadband signal reception/transfer may not be easily implemented in a limited space.

Thus, an antenna that may be inserted in the thin display device as a film or a patch and may have improved radiation reliability even in a thin structure may be needed.

For example, when a feeding is performed from a driving integrated circuit (IC) chip to an antenna, an impedance mismatching in the antenna may be caused due to a contact resistance between a pad of the antenna, and an external circuit structure or circuit wiring to degrade a radiation efficiency of the antenna.

SUMMARY

According to an aspect of the present invention, there is provided an antenna structure having improved signaling efficiency and reliability.

According to an aspect of the present invention, there is provided a display device including an antenna structure having improved signaling efficiency and reliability.

The above aspects of the present invention will be achieved by the following features or constructions:

(1) An antenna structure, including: a dielectric layer; a radiation pattern on the dielectric layer; and a signal pad on the dielectric layer, the signal pad including: a bonding region that is electrically connected to the radiation pattern; and a margin region adjacent to the bonding region.

(2) The antenna structure according to the above (1), further including an external circuit structure including: a conductive intermediate structure attached to the bonding region of the signal pad; and a flexible circuit board including a feeding wiring electrically connected to the signal pad via the conductive intermediate structure.

(3) The antenna structure according to the above (2), wherein the margin region does not directly contact the conductive intermediate structure.

(4) The antenna structure according to the above (2), further including a driving integrated circuit chip on the flexible circuit board, the driving integrated circuit chip supplying the radiation pattern with a power through the feeding wiring.

(5) The antenna structure according to the above (4), wherein the power corresponding to 40Ω to 70Ω is supplied by the driving integrated circuit chip such that the radiation pattern is operated in a frequency of 20 GHz to 30 GHz (6) The antenna structure according to the above (1), wherein a ratio of an area of the margin region relative to an area of the bonding region in the signal pad is in a range from 0.5 to 1.8.

(7) The antenna structure according to the above (1), wherein a ratio of an area of the margin region relative to an area of the bonding region in the signal pad is in a range from 0.7 to 1.4.

(8) The antenna structure according to the above (1), further including a transmission line connecting the radiation pattern and the signal pad to each other.

(9) The antenna structure according to the above (8), wherein the bonding region of the signal pad is directly connected to the transmission line.

(10) The antenna structure according to the above (8), wherein the margin region of the signal pad is directly connected to the transmission line.

(11) The antenna structure according to the above (1), wherein a width of the margin region is greater than a width of the bonding region.

(12) The antenna structure according to the above (1), wherein a margin region includes: a first portion extending in a length direction and contacting the bonding region; and a second portion expanding in a width direction from an end of the first portion.

(13) The antenna structure according to the above (1), further including a pair of ground pads spaced apart from the signal pad, the ground pads facing each other with respect to the signal pad.

(14) The antenna structure according to the above (13), wherein the ground pad has a length embracing the bonding region and the margin region.

(15) The antenna structure according to the above (1), wherein the radiation pattern has a mesh structure, and the signal pad has a solid structure.

(16) The antenna structure according to the above (1), further including a dummy mesh pattern around the radiation pattern on the dielectric layer.

(17) A display device including the antenna structure according to exemplary embodiments as described above.

In the antenna structure according to exemplary embodiments of the present invention as described above, a signal pad connected to a radiation pattern may include a bonding region adhered to an external circuit structure and a margin region that may not be directly adhered to the external circuit structure. The bonding region for the external circuit structure including a different material from that of the signal pad may be partially allocated, and a free region or an additional region of the signal pad may be provided by the margin region so that an impedance via the signal pad may be maintained within a desirable range.

Further, an area of the bonding region may be limited so that a radiation amount to the external circuit structure may be suppressed, and an amount of a power or an electric wave to the radiation pattern may be increased by the margin region.

In some embodiments, at least a portion of an antenna electrode layer may be formed as a mesh structure to improve a transmittance of the antenna structure. For example, the antenna structure may be employed to a display device that may include a mobile communication device capable of receiving and transferring a signal of high or ultra-high frequency band corresponding to 3G, 4G, 5G or more communication to provide improved radiation properties and optical properties such as the transmittance.

DETAILED DESCRIPTION OF THE EMBODIMENTS

According to exemplary embodiments of the present invention, there is a provided an antenna structure which includes a dielectric layer and an antenna electrode layer including a radiation pattern and a signal pad. In the antenna structure, the signal pad includes a bonding region and a margin region to provide an improved radiation efficiency. The antenna structure may include a microstrip patch antenna fabricated as a transparent film. The antenna structure may be employed to a communication device for high frequency or ultra-high frequency mobile communications.

According to exemplary embodiments of the present invention, a display device including the antenna structure is also provided. However, an application of the antenna structure is not limited to the display device, and the antenna structure may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

In the accompanying drawings, two directions being parallel to a top surface of a dielectric layer 110 and crossing each other are defined as a first direction and a second direction. For example, the first and second directions are perpendicular to each other. A direction vertical to the top surface of the dielectric layer 110 is defined as a third direction. For example, the first direction may correspond to a length direction of the antenna structure, the second direction may correspond to a width direction of the antenna structure, and the third direction may correspond to a third direction of the antenna structure.

Figure 1:
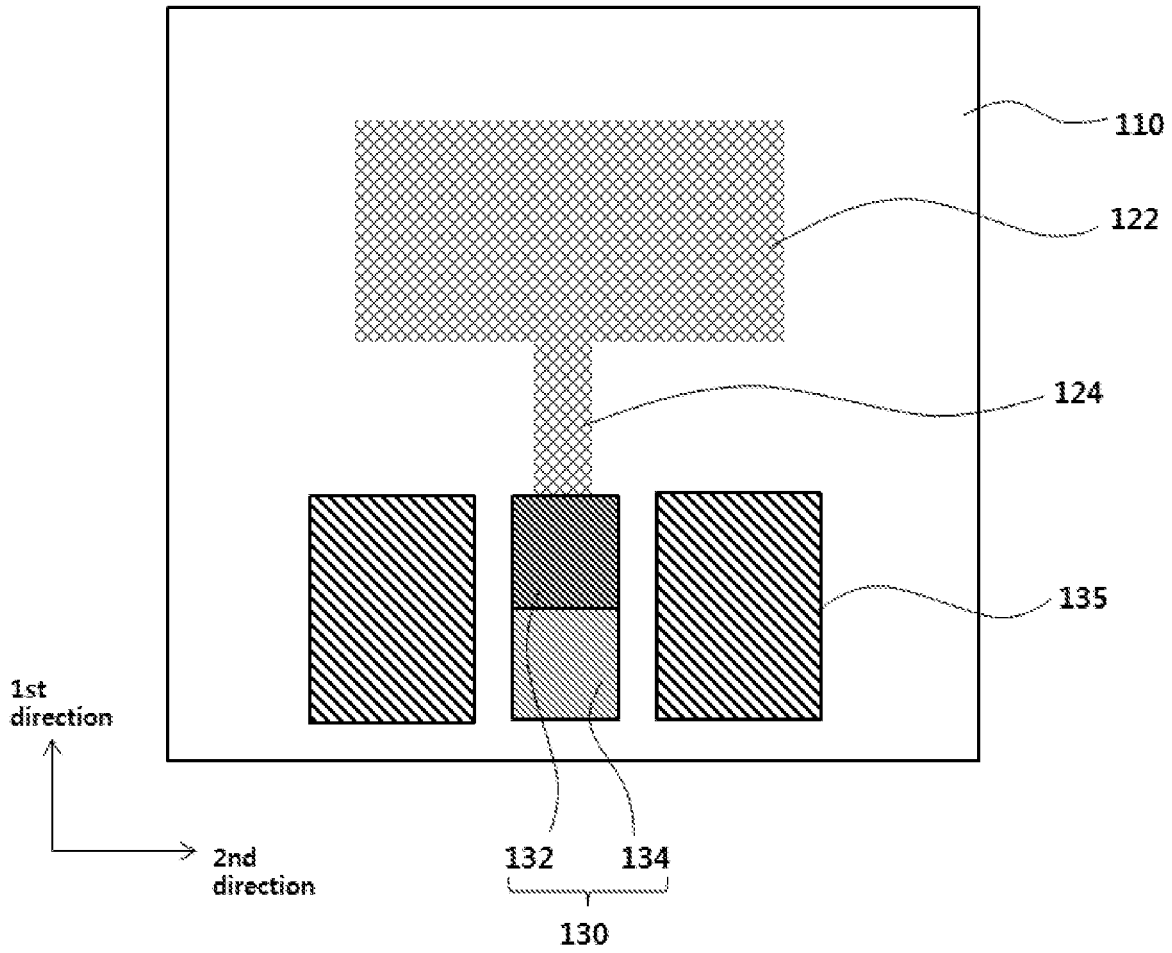
FIG. 1 is a schematic top-planar view illustrating an antenna electrode layer of an antenna structure in accordance with exemplary embodiments.

FIG. 1 is a schematic top-planar view illustrating an antenna electrode layer of an antenna structure in accordance with exemplary embodiments.

Referring to FIG. 1, an antenna structure may include a dielectric layer 110 and an antenna electrode layer disposed on the dielectric layer 110. The antenna electrode layer may include a radiation pattern 122 and a signal pad 130 electrically connected to the radiation pattern 122. The radiation pattern 122 and the signal pad 130 may be electrically connected to each other via a transmission line 124.

The dielectric layer 110 may include, e.g., a transparent resin material. The dielectric layer 110 may include, e.g., a polyester-based resin such as polyethylene terephthalate, polyethylene isophthalate, polyethylene naphthalate, polybutylene terephthalate, or the like; a cellulose-based resin such as diacetyl cellulose, triacetyl cellulose, or the like; a polycarbonate-based resin; an acrylic resin such as polymethyl(meth)acrylate, polyethyl(meth)acrylate, or the like; a styrene-based resin such as polystyrene, acrylonitrile-styrene copolymer, or the like; a polyolefin-based resin such as polyethylene, polypropylene, a cyclo-based polyolefin, a norbornene-structured polyolefin, ethylene-propylene copolymer, or the like; a vinyl chloride-based resin; an amide-based resin such as nylon, an aromatic polyamide, or the like; an imide-based resin; a polyether sulfone-based resin; a sulfone-based resin; a polyether ether ketone-based resin; a polyphenylene sulfide-based resin; a vinyl alcohol-based resin; a vinylidene chloride-based resins; a vinyl butyral-based resin; an allylate-based resin; a polyoxymethylene-based resin; an epoxy-based resin; a urethane or acryl urethane-based resin; a silicone-based resin, etc. These may be used alone or in a combination thereof.

In some embodiments, an adhesive film including an optically clear adhesive (OCA) or an optically clear resin (OCR) may be included in the dielectric layer 110.

In some embodiments, the dielectric layer 110 may include an inorganic insulation material such as silicon oxide, silicon nitride, silicon oxynitride, glass, etc.

In an embodiment, the dielectric layer 110 may be a substantially single layer. In an embodiment, the dielectric layer 110 may have a multi-layered structure including at least two layers.

A capacitance or an inductance may be generated between the antenna electrode layer and an antenna ground layer 140 (see FIG. 2) by the dielectric layer 110 so that a frequency range at which the antenna structure is operated may be controlled. In some embodiments, a dielectric constant of the dielectric layer 110 may be in a range from about 1.5 to about 12. If the dielectric constant exceeds about 12, a driving frequency may be excessively decreased and a desired high-frequency antenna operation may not be implemented.

As described above, the antenna electrode layer may include the radiation pattern 122 and the signal pad 130, and the radiation pattern 122 and the signal pad 130 may be electrically connected to each other via the transmission line 124.

For example, the transmission line 124 may extend from a central portion of the radiation pattern 122 to be connected to the signal pad 130. In an embodiment, the transmission line 124 may be substantially integrally connected to the radiation pattern 122 as a unitary member. In an embodiment, the transmission line 124 may be also substantially integrally connected to the signal pad 130 as a unitary member.

The signal pad 130 may transfer a power from an external circuit structure to the radiation pattern 122. In exemplary embodiments, the signal pad 130 may include a bonding region 132 and a margin region 134.

The bonding region 132 may serve as a region which may be directly attached or bonded to the external circuit structure. For example, the external circuit structure may include a flexible circuit board (e.g., FPCB) 200 and a conductive intermediate structure 150 as described with reference to FIGS. 2 and 3 below.

The margin region 134 may be a region which may not be directly attached or bonded to the external circuit structure. The margin region 134 may include a remaining portion of the signal pad 130 except for the bonding region 132.

Figure 2:
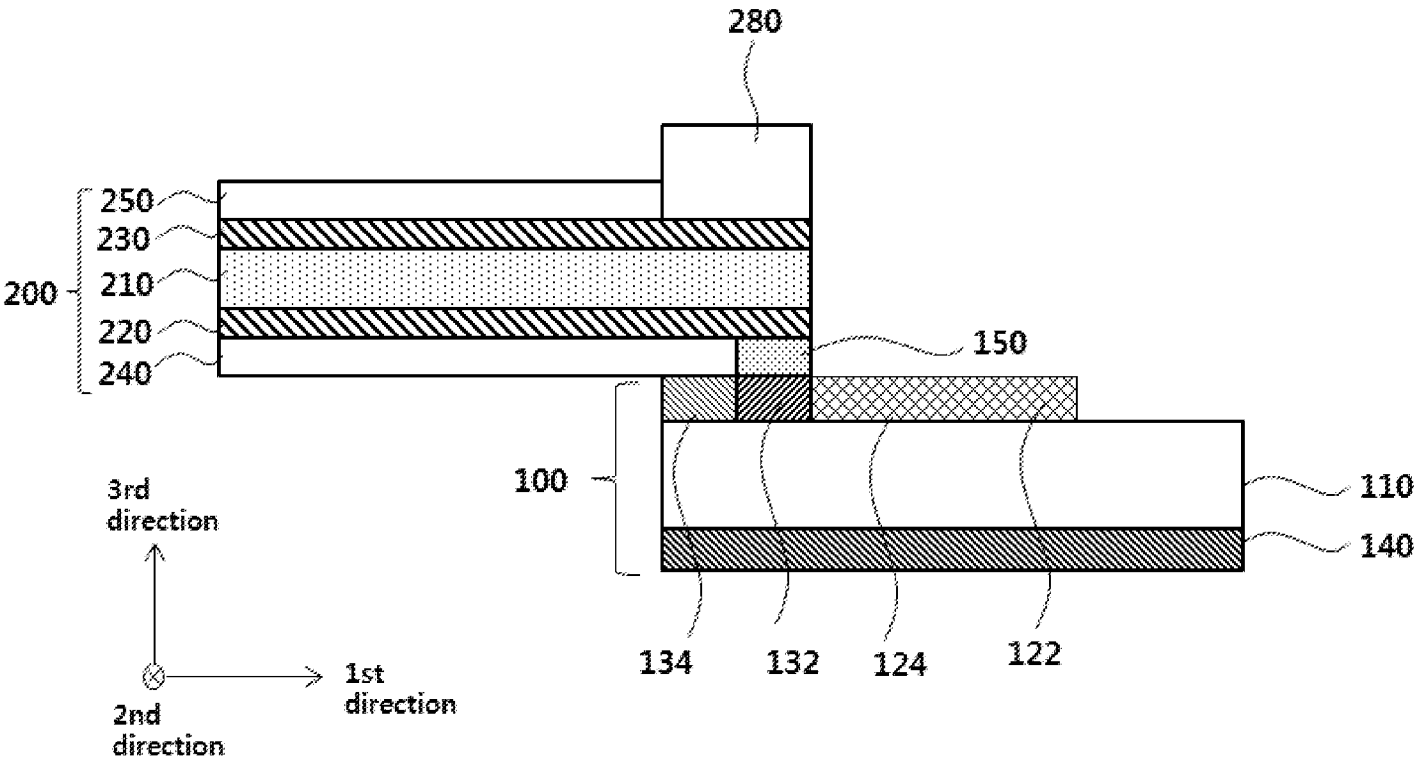
FIG. 2 is a schematic cross-sectional view illustrating an antenna structure in accordance with exemplary embodiments.

For example, in a high frequency communication in a range from about 20 GHz to about 30 GHz, an impedance may be set within a range from 40Ω to 70Ω, preferably 50Ω to 60Ω, more preferably around about 50Ω to implement a resonance without a signal reflectance via a driving integrated circuit chip 280 (see FIG. 2).

A conductive pattern included in the external circuit structure may include a conductive material different from that of the signal pad 130. In this case, an impedance value set by the antenna electrode layer may be changed or disturbed due to a contact resistance with the signal pad 130 to cause an impedance mismatching. Further, when an area of the signal pad 130 is increased for improving a feeding or radiation transfer efficiency to the radiation pattern 122, the impedance mismatching may be exacerbated.

However, according to exemplary embodiments, the bonding region 132 for attaching the external circuit structure to the signal pad 130 may be partially allocated, and the margin region 134 may be additionally allocated. Accordingly, a desired impedance may be maintained through the margin region 134, and the impedance mismatching that may be caused at the bonding region 132 may be reduced or suppressed.

Further, a sufficient radiation or feeding amount to the radiation pattern 122 may be obtained by the margin region 134. Thus, even when the area of the signal pad 130 is increased, the impedance mismatching may be prevented while achieving sufficient radiation efficiency and antennal gain properties.

As illustrated in FIG. 1, the bonding region 132 of the signal pad 130 may be adjacent with the transmission line 124. In this case, a signal transfer path between the external circuit structure and the radiation pattern 122 may become shorter. For example, a front-end portion in the first direction of the signal pad 130 may correspond to the bonding region 132, a rear-end portion of the signal pad 130 may correspond to the margin region 134.

In some embodiments, a ratio of an area of the margin region 134 relative to an area of the bonding region 132 may be in a range from about 0.5 to about 1.8. Within this range, the gain amount may be increased and a noise due to the impedance mismatching may be prevented by the margin region 134 without degrading a feeding efficiency from the external circuit structure.

Preferably, the ratio of the area of the margin region 134 relative to the area of the bonding region 132 may be in a range from about 0.7 to about 1.4. More preferably, the ratio of the area of the margin region 134 relative to the area of the bonding region 132 may be in a range from about 0.9 to about 1.4.

The antenna electrode layer may further include a ground pad 135. The ground pad 135 may be disposed around the signal pad 130 to be electrically and physically separated from the signal pad 130. For example, a pair of the ground pads 135 may face each other in the second direction with respect to the signal pad 130.

The ground pad 135 may be disposed at the same layer or at the same level (e.g., a top surface of the dielectric layer 110) as that of the antenna electrode layer. In this case, a lateral radiation property may be also provided by the antenna structure. As described below with reference to FIG. 2, the antenna structure may further include an antenna ground layer 140 on a lower surface of the dielectric layer. In this case, a vertical radiation property may be implemented by the antenna structure.

As illustrated in FIG. 1, a length (a length in the first direction) of the ground pad 135 may embrace both the bonding region 132 and the margin region 134. For example, the length of the ground pad 135 may be equal to or greater than an entire length of the signal pad 130.

The antenna electrode layer may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy thereof. These may be used alone or in a combination thereof.

For example, silver (Ag) or a silver alloy (e.g., a silver-palladium-copper (APC) alloy) may be used to provide a low resistance.

In an embodiment, the antenna electrode layer may include copper (Cu) or a copper alloy in consideration of low resistance and pattern formation with a fine line width. For example, the antenna electrode layer may include a copper-calcium (Cu—Ca) alloy.

In some embodiments, the antenna electrode layer may include a transparent metal oxide such as indium tin oxide (ITO), indium zinc oxide (IZO), indium tin zinc oxide (ITZO), or zinc oxide ($ZnO_x$). In some embodiments, the antenna electrode layer may have a multi-layered structure including a transparent metal oxide layer and a metal layer. For example, the antenna electrode layer may have a triple-layered structure of a first transparent metal oxide layer—the metal layer—a second transparent metal oxide layer. In this case, conductivity and flexibility may be improved by the metal layer, and transparency and chemical stability may be enhanced by the transparent metal oxide layers.

In some embodiments, the radiation pattern 122 may include a mesh structure. In this case, transmittance of the radiation pattern 122 may be improved, and the radiation pattern 122 may be suppressed from being recognized by a user when the antenna structure is mounted on a display device. In one embodiment, the transmission line 124 may also be patterned together with the radiation pattern 122 to include the mesh structure.

In some embodiments, the signal pad 130 may have a solid structure. Accordingly, a contact resistance between the bonding region 132 and the external circuit structure may be reduced, and efficiency of transferring electric wave and power to the radiation pattern 122 through the margin region 134 may be increased. In one embodiment, the ground pad 135 may also have a solid structure for noise absorption efficiency.

FIG. 2 is a schematic cross-sectional view illustrating an antenna structure in accordance with exemplary embodiments.

Referring to FIG. 2, the antenna structure may include a film antenna 100 and a flexible circuit board (FPCB) 200. The antenna structure may further include a driving integrated circuit (IC) chip 280 electrically connected to the film antenna 100 via the flexible circuit board 200.

As described with reference to FIG. 1, the film antenna 100 may include the dielectric layer 110 and the antenna electrode layer disposed on an upper surface of the dielectric layer 110. The antenna electrode layer may include the radiation pattern 122, the transmission line 124 and the signal pad 130, and the signal pad 130 may include the bonding region 132 and the margin region 134. The ground pad 135 spaced apart from the signal pad 130 may be further disposed around the signal pad 130.

In some embodiments, an antenna ground layer 140 may be formed on a lower surface of the dielectric layer 110. The antenna ground layer 140 may entirely overlap the antenna electrode layer in a planar view.

In an embodiment, a conductive member of a display device or a display panel on which the antenna structure is mounted may be provided as the antenna ground layer 140. For example, the conductive member may include electrodes or wires such as a gate electrode, source/drain electrodes, a pixel electrode, a common electrode, a data line, a scan line, etc., included in a thin film transistor (TFT) array panel.

The flexible circuit board 200 may be disposed on the antenna electrode layer to be electrically connected to the film antenna 100. The flexible circuit board 200 may include a core layer 210, a feeding wiring 220, and a feeding ground 230. An upper coverlay film 250 and a lower coverlay film 240 may be formed on upper and lower surfaces of the core layer 210, respectively, for protecting the wirings.

The core layer 210 may include, e.g., a flexible resin material such as polyimide, an epoxy resin, polyester, cyclo olefin polymer (COP), liquid crystal polymer (LCP), or the like.

The feeding wiring 220 may be disposed, for example, on the lower surface of the core layer 210. The feeding wiring 220 may serve as a wiring for distributing power from the driving integrated circuit (IC) chip 280 to the antenna electrode layer or the radiation pattern 122.

In exemplary embodiments, the feeding wiring 220 may be electrically connected to the signal pad 130 of the antenna electrode layer via a conductive intermediate structure 150.

The conductive intermediate structure 150 may be fabricated from, e.g., an anisotropic conductive film (ACF). In this case, the conductive intermediate structure 150 may include conductive particles (e.g., silver particles, copper particles, carbon particles, etc.) dispersed in a resin layer.

As described with reference to FIG. 1, the conductive intermediate structure 150 may be selectively bonded or contacted with the bonding region 132 included in the signal pad 130, and the margin region 134 of the signal pad 130 may remain as an non-bonding region with the conductive intermediate structure 150.

As described above, the conductive intermediary structure 150 may include a material different from that included in the signal pad 130, such as a resin material and conductive particles, thereby causing the impedance mismatching in the antenna electrode layer. However, according to exemplary embodiments, the impedance mismatching may be alleviated or suppressed by allocating the margin region 134 that may not be bonded to the conductive intermediate structure 150.

For example, the lower coverlay film 240 may be partially cut or removed to expose a portion of the feeding wiring 220 having a size corresponding to the bonding region 132. The exposed feeding line 220 and the bonding region 132 may be pressurized and bonded to each other through the conductive intermediary structure 150.

In some embodiments, the lower coverlay film 240 may be disposed on the margin region 134. In some embodiments, the margin region 134 may further provide alignment margin in a bonding process of the flexible circuit board 200 and the conductive intermediate structure 150. Thus, an additional bonding margin may be provided by the margin region 134 when miss-alignment on the bonding region 132 occurs.

The feeding ground 230 may be disposed on an upper surface of the core layer 210. The feeding ground 230 may have a line shape or a plate shape. The feeding ground 230 may serve as a barrier for shielding or suppressing noise or self-radiation generated from the feeding wiring 220.

The feed wiring 220 and the feeding ground 230 may include the metal and/or alloy as mentioned in the antenna electrode layer.

In some embodiments, the feeding ground 230 may be electrically connected to the ground pad 135 (see FIG. 1) of the antenna electrode layer through a ground contact (not illustrated) formed through the core layer 210.

The driving IC chip 280 may be disposed on the flexible circuit board 200. A power may be supplied from the driving IC chip 280 to the antenna electrode layer through the feeding wiring 220. For example, the flexible circuit board 200 may further include a circuit or a contact electrically connecting the driving IC chip 280 and the feeding wiring 220. In an embodiment, the driving IC chip 280 may be mounted directly on the flexible circuit board 200.

FIGS. 3 to 6 are top-planar views illustrating antenna electrode layers of antenna structures in accordance with some exemplary embodiments. Detailed descriptions on elements/structures substantially the same as or similar to those illustrated with reference to FIG. 1 are omitted herein.

Figure 3:
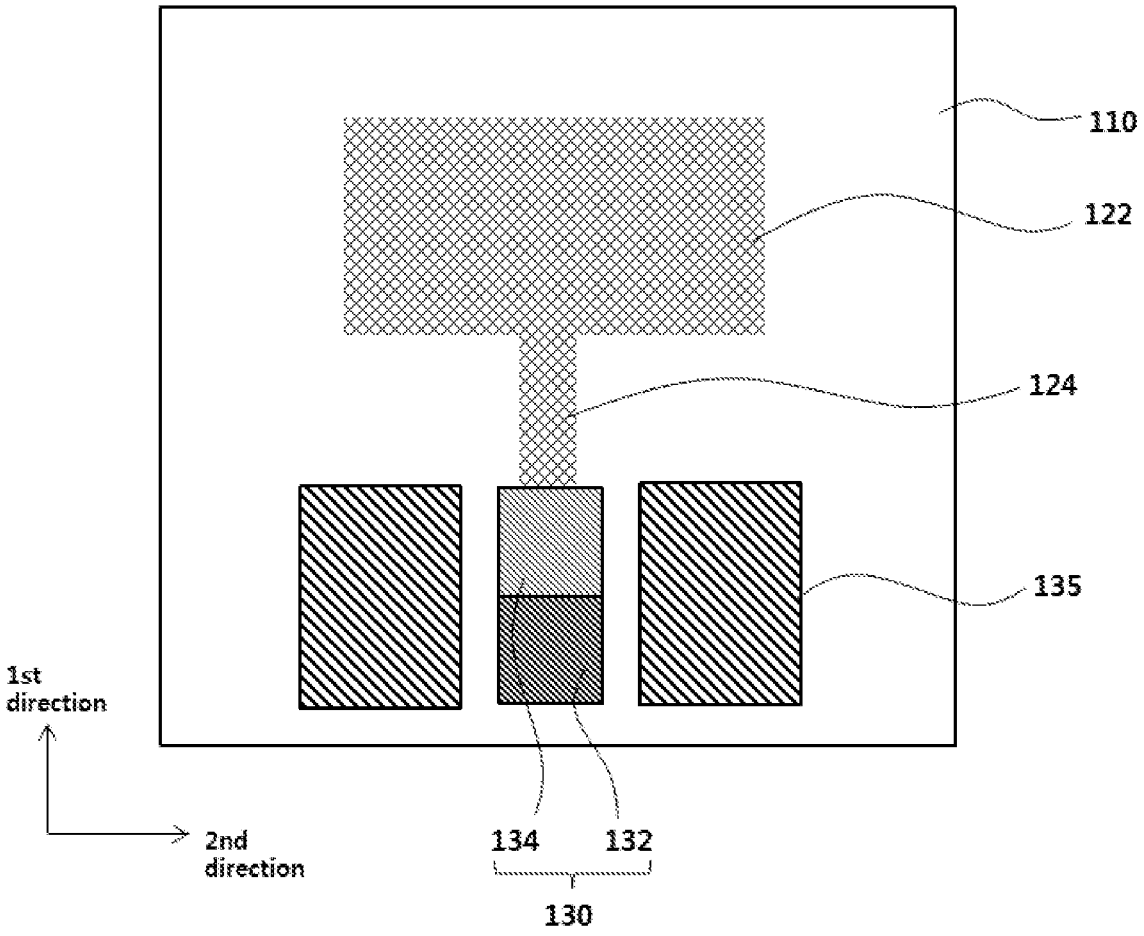
FIGS. 3 to 6 are top-planar views illustrating antenna electrode layers of antenna structures in accordance with some exemplary embodiments.

Referring to FIG. 3, the margin region 134 of the signal pad 130 may be disposed adjacent to the transmission line 124. For example, a front-end portion of the signal pad 130 in the first direction may serve as the margin region 134, and a rear-end portion may serve as the bonding region 132 of the signal pad 130. In this case, the margin region 134 may be directly connected to the transmission line 124.

In an embodiment of FIG. 3, the margin region 134 may be disposed between the bonding region 132 and the transmission line 124 so that the impedance mismatching may be resolved before electric wave or power is supplied to the radiation pattern 122 and directivity of electric wave or power to the radiation pattern 122 may be improved.

Figure 4:
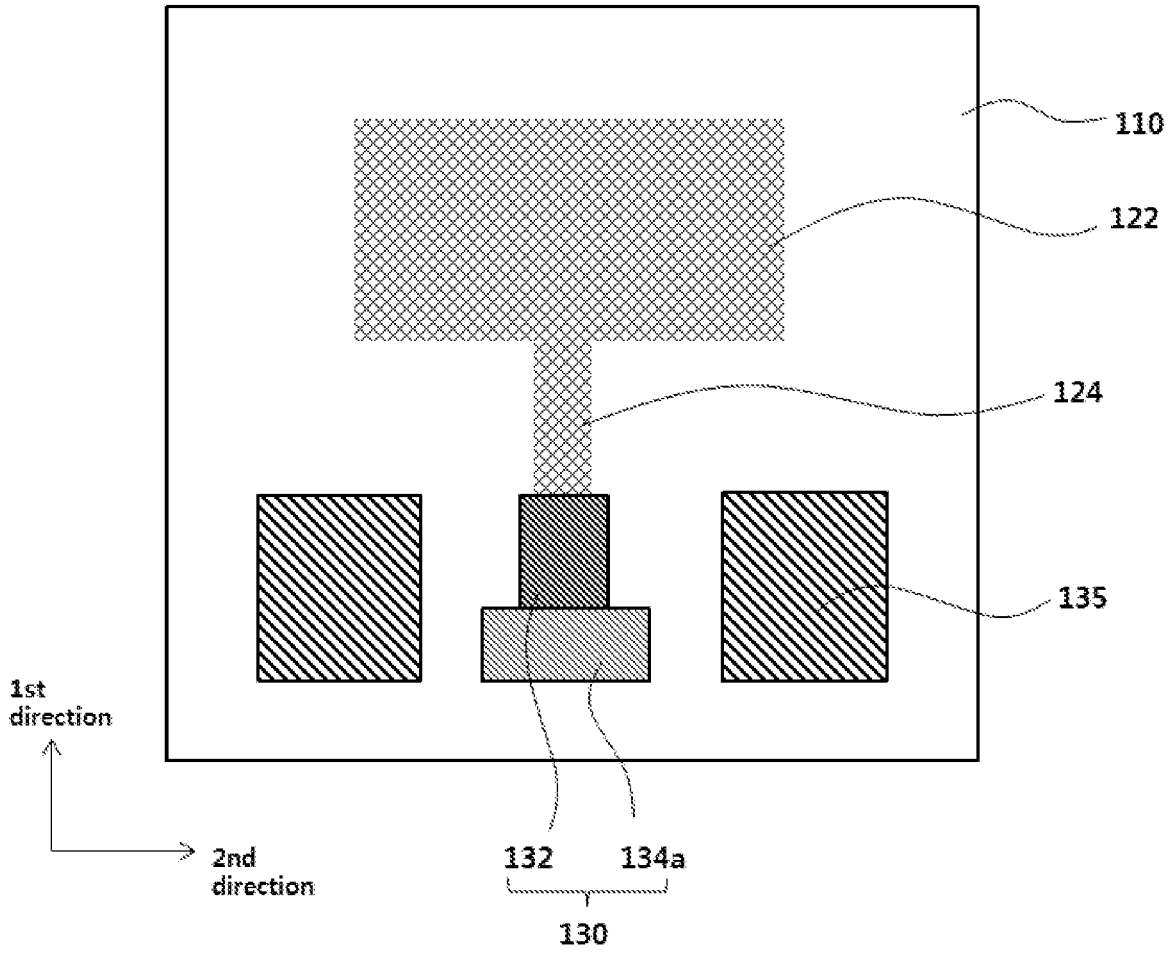

Referring to FIG. 4, a margin region **134*a* may have a greater width (e.g., a width in the second direction) than that of the bonding region 132. In this case, an additional alignment margin may be achieved by the margin region 134*a* when a misalignment of the flexible circuit board 200 or the conductive intermediate structure 150 to the bonding region 132** occurs.

Additionally, a length of the margin region **134*a* may be relatively reduced so that an entire area for the signal pad 130** may be reduced.

Figure 5:
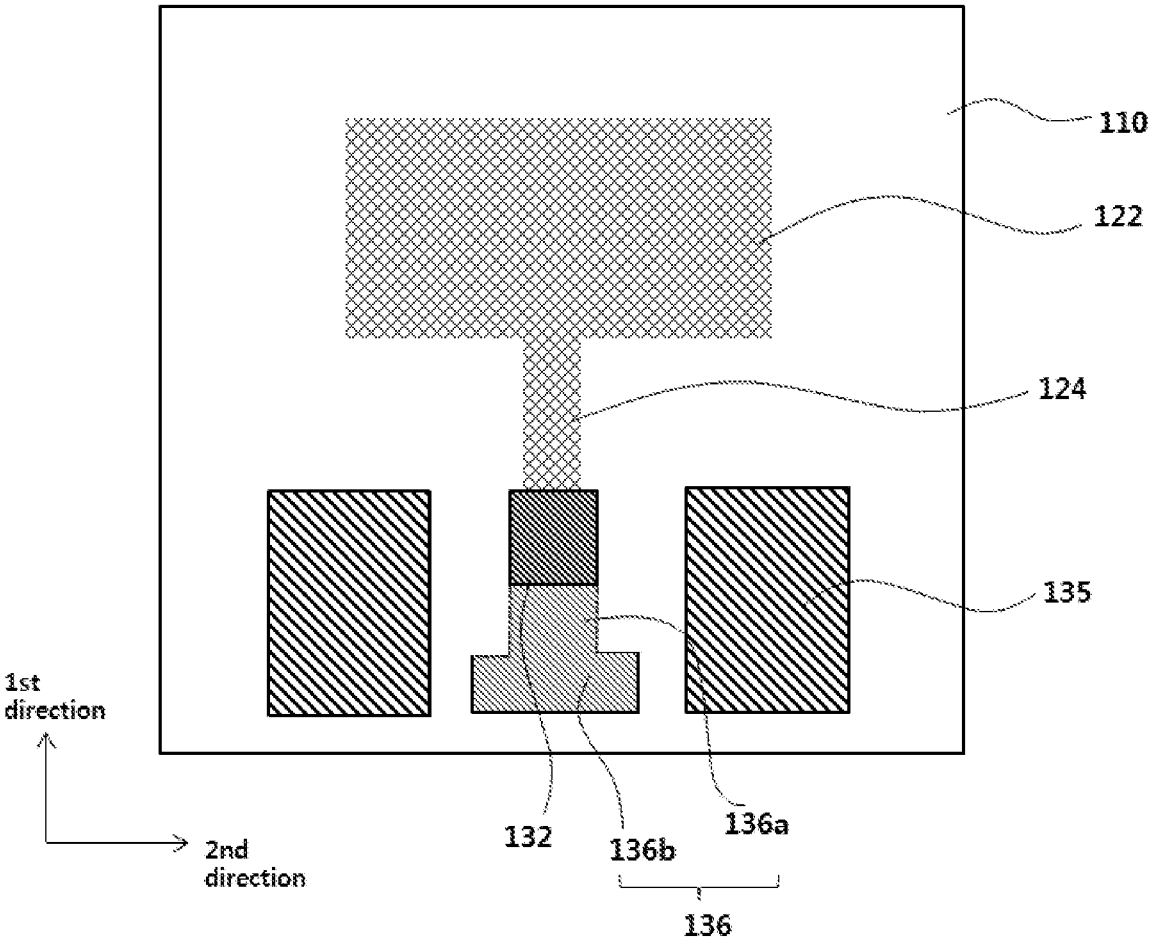

Referring to FIG. 5, a margin region 136 may include an extended portion in a width direction (e.g., the second direction).

For example, the margin region 136 may include a first portion **136*a* extending in a length direction (e.g., the first direction) and contacting the bonding region 132, and a second portion extended in the width direction from an end portion of the first portion 136***a*.

The impedance mismatching may be alleviated or suppressed by the first portion 136*a* having a shape substantially the same as or similar to that of the bonding region 132. A resistance of the signal pad 130 may be further reduced by the second portion 136*b* so that an efficiency of supplying electric wave and power to the radiation pattern 122 may be enhanced.

Figure 6:
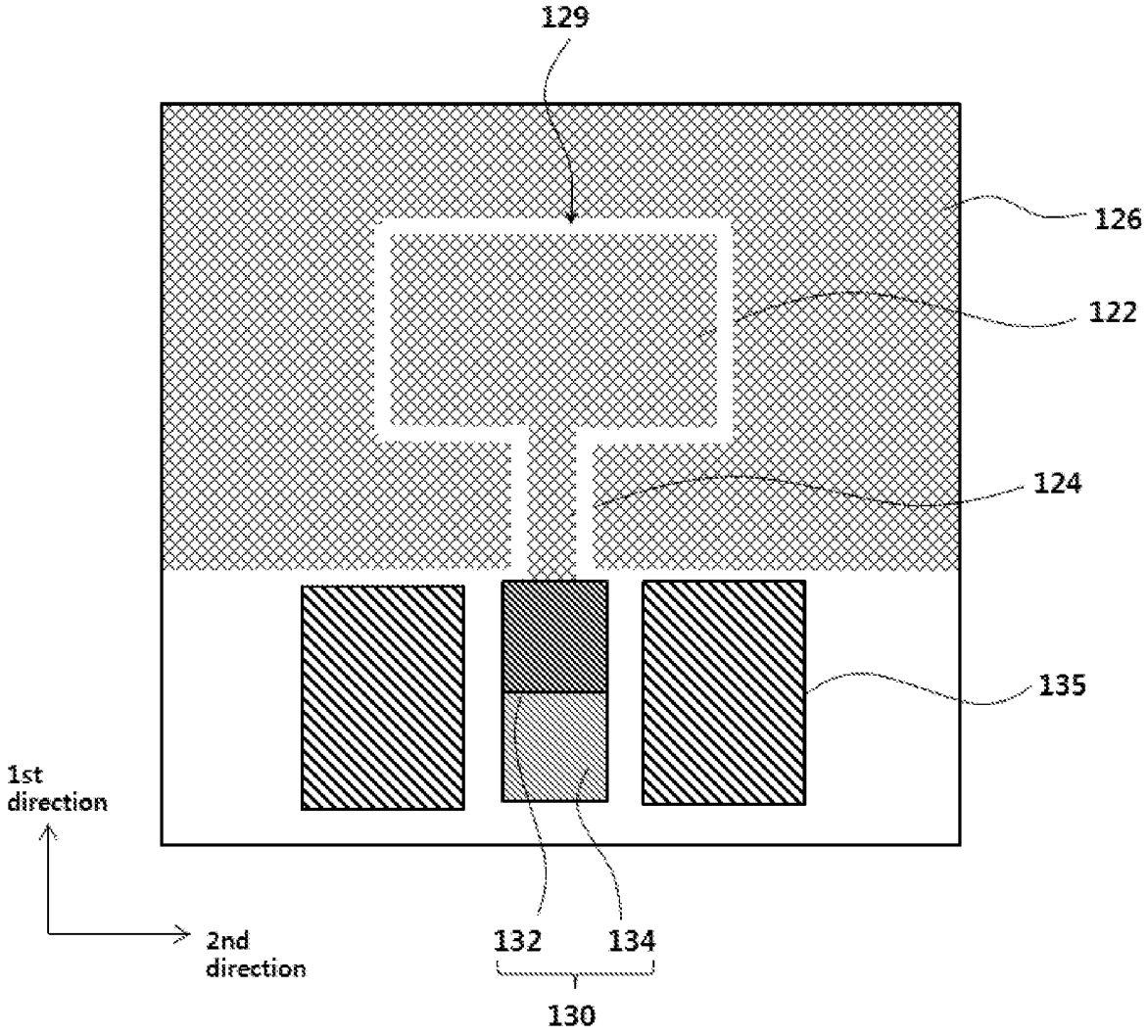

Referring to FIG. 6, when the radiation pattern 122 includes a mesh structure, a dummy mesh pattern 126 may be disposed around the radiation pattern 122. As described with reference to FIG. 1, the radiation pattern 122 may include the mesh structure so that transmittance of the film antenna 100 or the antenna structure may be improved.

The dummy mesh pattern 126 may be disposed around the radiation pattern 122 so that an electrode arrangement around the radiation pattern 122 may become uniform to prevent the mesh structure or electrode lines included therein from being recognized by the user of the display device.

For example, a mesh metal layer may be formed on the dielectric layer 110, and the mesh metal layer may be etched along a predetermined separation region 129 to form the dummy mesh pattern 126 electrically and physically separated from the radiation pattern 122 and the transmission line 124.

As illustrated in FIG. 6, when the transmission line 124 also includes the mesh structure, the dummy mesh pattern 126 may be also formed around the transmission line 124. In an embodiment, the signal pad 130 and/or the ground pad 135 may also include a mesh structure. In this case, the dummy mesh pattern 126 may be also formed around the signal pad 130 and/or the ground pad 135.

Figure 7:
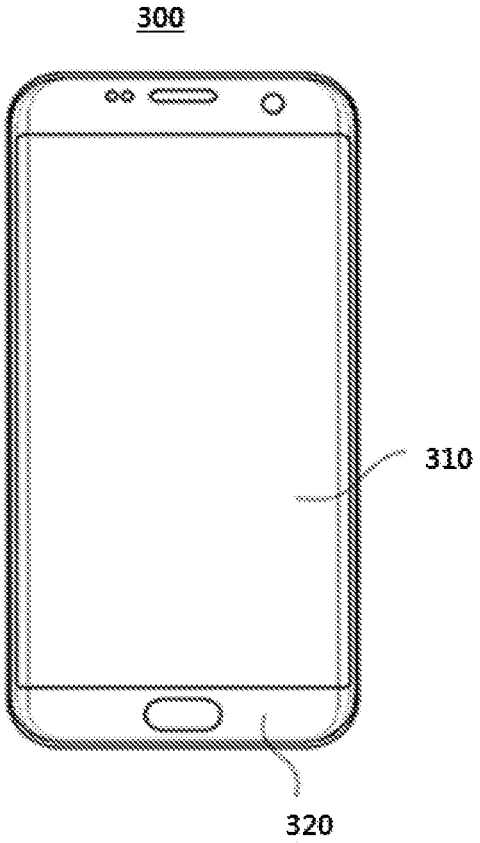
FIG. 7 is a schematic top planar view illustrating a display device in accordance with exemplary embodiments.

FIG. 7 is a schematic top planar view illustrating a display device in accordance with exemplary embodiments. For example, FIG. 7 illustrates an outer shape including a window of a display device.

Referring to FIG. 7, a display device 300 may include a display area 310 and a peripheral area 320. For example, the peripheral area 320 may be disposed at both lateral portions and/or both end portions of the display area 310.

In some embodiments, the film antenna 100 included in the above-described antenna structure may be inserted in the peripheral area 320 of the display device 300 as a patch structure. In some embodiments, the signal pad 130 and the ground pad 135 of the film antenna 100 may be disposed at the peripheral area 320 of the display device 300.

The peripheral area 320 may correspond to, e.g., a light-shielding portion or a bezel portion of the image display device. In exemplary embodiments, the flexible circuit board 200 of the antenna structure may be disposed at the peripheral area 320 to prevent image degradation in the display area 310 of the display device 300.

Further, the driving IC chip 280 may be also disposed on the flexible circuit board 200 at the peripheral area 320. The pads 130 and 135 of the film antenna may be arranged to be adjacent to the flexible circuit board 200 and the driving IC chip 280 at the peripheral area 320 so that signal transmission and reception path may be shortened to suppress signal loss.

The radiation patterns 122 of the film antenna 100 may at least partially overlap the display area 310. For example, as illustrated in FIG. 6, the mesh structure may be utilized to reduce the visibility of the radiation pattern 122 to a user.

Hereinafter, preferred embodiments are proposed to more concretely describe the present invention. However, the following examples are only given for illustrating the present invention and those skilled in the related art will obviously understand that these examples do not restrict the appended claims but various alterations and modifications are possible within the scope and spirit of the present invention. Such alterations and modifications are duly included in the appended claims.

Experimental Example: Measurement of S11 Depending on Changes in Length/Area of Margin Region A signal pad including a silver-palladium-copper (APC) alloy and having a width of 250 mm was formed on a polyimide dielectric layer. A length of a bonding region of the signal pad was fixed to 650 mm. An ACF layer was formed on the bonding region, a copper feeding wiring of a flexible circuit board was exposed, and then the bonding region and the copper feeding wiring were bonded to each other. An S-parameter (S11) and a gain amount at a frequency of about 28.5 GHz using a network analyzer with an impedance of 50Ω with respect to the flexible circuit board-signal pad connection structure were extracted while increasing a length of a margin region where the ACF layer was not formed. The simulation results were shown in a graph of FIG. 8.

Figure 8:
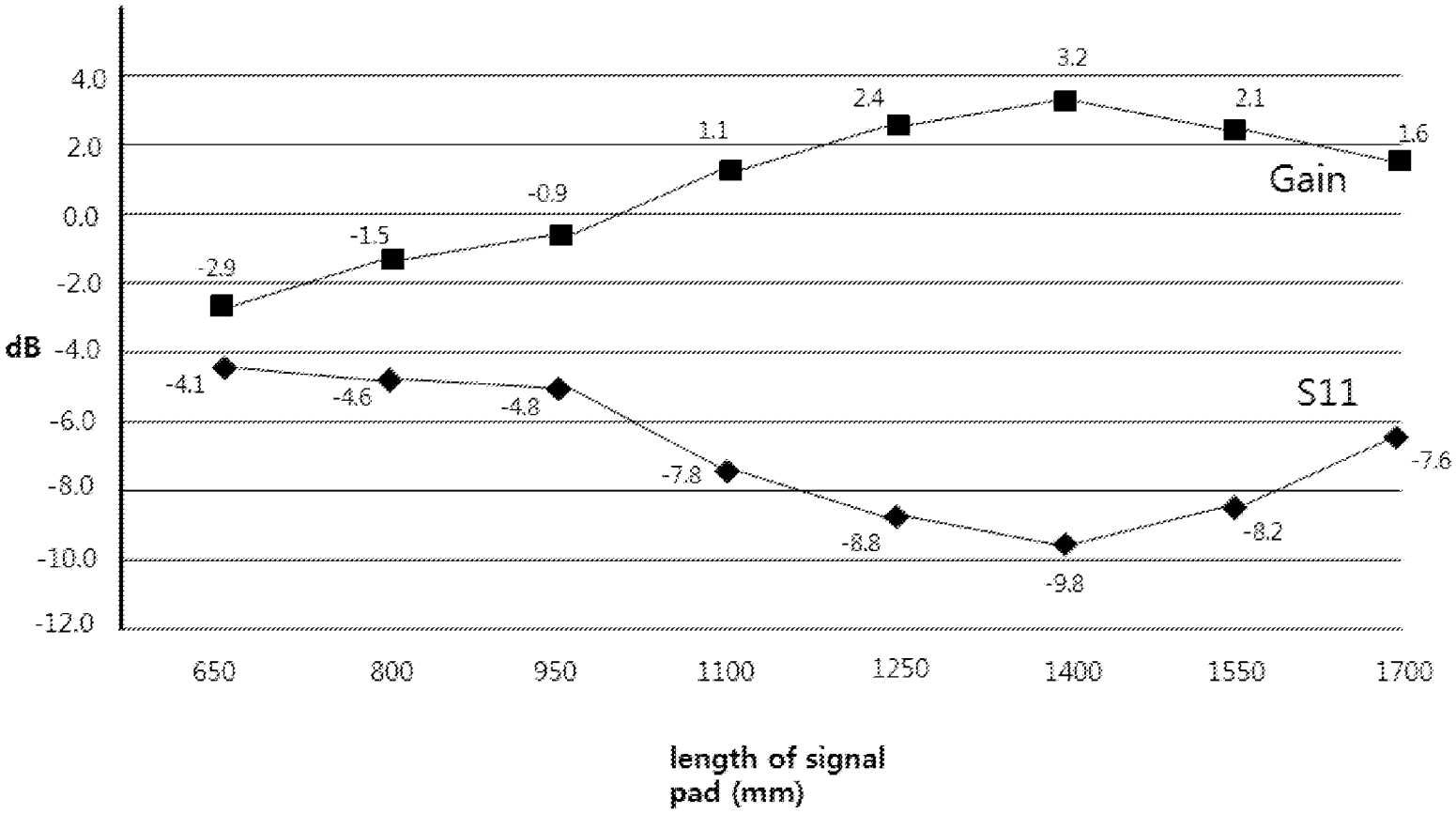
FIG. 8 is a graph showing changes of an S-parameter and a gain amount based on a change of a margin region length of an antenna structure according to exemplary embodiments.

Referring to FIG. 8, as the length of the margin region increased (an area ratio of the margin region increased), the gain amount increased and the S11 value decreased (i.e., a radiation efficiency increased). More specifically, the increase of the gain amount and the reduction of the S11 value were observed from when the length of the signal pad was about 950 mm (the length of the margin region: 300 mm, an area ratio of the margin region relative to the bonding region: about 0.46). When the area ratio exceeded about 0.5, the increase of the gain amount and the reduction of the S11 value were explicitly observed. However, when the length of the margin region (the area ratio of the margin region relative to the bonding region) excessively increased, the gain amount deceased and the S11 value increased again.

What is claimed is:

1. An antenna structure, comprising:
- a dielectric layer;
- a radiation pattern on the dielectric layer;
- a signal pad on the dielectric layer;
- a transmission line connecting the radiation pattern and the signal pad to each other; and
- an external circuit structure electrically connected to the signal pad,
- wherein the signal pad comprises:
  - a bonding region that is electrically connected to the radiation pattern; and
  - a margin region adjacent to the bonding region; and
- the external circuit structure is bonded to the signal pad only via the bonding region.

2. The antenna structure according to claim 1, wherein the external circuit structure comprises:
- a conductive intermediate structure attached to the bonding region of the signal pad; and
- a flexible circuit board comprising a feeding wiring electrically connected to the signal pad via the conductive intermediate structure.

3. The antenna structure according to claim 2, wherein the margin region does not directly contact the conductive intermediate structure.

4. The antenna structure according to claim 2, further comprising a driving integrated circuit chip on the flexible circuit board, the driving integrated circuit chip supplying the radiation pattern with a power through the feeding wiring.

5. The antenna structure according to claim 4, wherein the power corresponding to 40Ω to 70Ω is supplied by the driving integrated circuit chip such that the radiation pattern is operated in a frequency of 20 GHz to 30 GHz.

6. The antenna structure according to claim 1, wherein a ratio of an area of the margin region relative to an area of the bonding region in the signal pad is in a range from 0.5 to 1.8.

7. The antenna structure according to claim 1, wherein a ratio of an area of the margin region relative to an area of the bonding region in the signal pad is in a range from 0.7 to 1.4.

8. The antenna structure according to claim 1, wherein the bonding region of the signal pad is directly connected to the transmission line.

9. The antenna structure according to claim 1, wherein the margin region of the signal pad is directly connected to the transmission line.

10. The antenna structure according to claim 1, wherein a width of the margin region is greater than a width of the bonding region.

11. The antenna structure according to claim 1, wherein a margin region comprises:

a first portion extending in a length direction and contacting the bonding region; and a second portion expanding in a width direction from an end of the first portion.

12. The antenna structure according to claim 1, further comprising a pair of ground pads spaced apart from the signal pad, the pair of ground pads facing each other with respect to the signal pad.

13. The antenna structure according to claim 12, wherein the ground pad has a length embracing the bonding region and the margin region.

14. The antenna structure according to claim 1, wherein the radiation pattern has a mesh structure, and the signal pad has a solid structure.

15. The antenna structure according to claim 1, further comprising a dummy mesh pattern around the radiation pattern on the dielectric layer.

16. A display device comprising the antenna structure of claim 1.

* * * * *